US009293241B2

(12) United States Patent
Brown et al.

(10) Patent No.: US 9,293,241 B2
(45) Date of Patent: Mar. 22, 2016

(54) COMMUNICATION CABLE

(75) Inventors: Scott M. Brown, Independence, KY (US); David P. Camp, II, Florence, KY (US)

(73) Assignee: General Cable Technologies Corporation, Highland Heights, KY (US)

( * ) Notice: Subject to any disclaimer, the term of this patent is extended or adjusted under 35 U.S.C. 154(b) by 877 days.

(21) Appl. No.: 12/901,134

(22) Filed: Oct. 8, 2010

(65) Prior Publication Data

US 2011/0083878 A1 Apr. 14, 2011

Related U.S. Application Data

(60) Provisional application No. 61/249,698, filed on Oct. 8, 2009.

(51) Int. Cl.
*H01B 13/14* (2006.01)
*H01B 7/295* (2006.01)
*H01B 3/44* (2006.01)

(52) U.S. Cl.
CPC ..... *H01B 13/141* (2013.01); *H01B 3/445* (2013.01); *H01B 7/295* (2013.01)

(58) Field of Classification Search
CPC ..... H01B 3/441; H01B 3/427; H01B 3/445; H01B 7/185; H01B 7/189; H01B 7/0233; H01B 7/295
USPC ..... 174/110, 120, 112, 113, 110 R, 110 SR, 174/110 PM, 120 C, 120 SR, 113 R
See application file for complete search history.

(56) References Cited

U.S. PATENT DOCUMENTS

| | | | | |
|---|---|---|---|---|
| 4,352,701 | A | 10/1982 | Shimba et al. | |
| 5,571,462 | A * | 11/1996 | Hashimoto et al. | 264/45.9 |
| 5,670,748 | A * | 9/1997 | Gingue et al. | 174/12 R |
| 5,718,974 | A * | 2/1998 | Kmiec | 428/383 |
| 5,841,073 | A * | 11/1998 | Randa et al. | 174/113 R |
| 7,449,638 | B2 | 11/2008 | Clark et al. | |
| 7,473,848 | B2 | 1/2009 | Kenny et al. | |
| 7,638,709 | B2 | 12/2009 | Kenny et al. | |
| 7,643,018 | B1 | 1/2010 | Brown et al. | |
| 8,354,461 | B2 * | 1/2013 | Venkataraman et al. | 524/165 |
| 2003/0178223 | A1 * | 9/2003 | Varkey et al. | 174/120 R |
| 2007/0015875 | A1 * | 1/2007 | Globus et al. | 525/199 |
| 2008/0073105 | A1 * | 3/2008 | Clark et al. | 174/112 |
| 2009/0151970 | A1 * | 6/2009 | Abe et al. | 174/28 |

FOREIGN PATENT DOCUMENTS

JP 06139850 A * 5/1994 ..... B29C 47/02

* cited by examiner

*Primary Examiner* — Timothy Thompson
*Assistant Examiner* — Paresh Paghadal
(74) *Attorney, Agent, or Firm* — Ulmer & Berne LLP

(57) ABSTRACT

The present invention relates generally to cables suitable for use in plenum applications. In particular, the present invention relates to coaxial cables suitable for use in plenum applications (which exhibit flame spread and smoke generation properties that comply with industry standards, e.g., UL 910 or NFPA 262) without compromising electrical performance. The cable has two or more layers of insulation where the inner layer is made of a material having a high melt flow index and the outer layer is made of a material having a low melt flow index and the outer layer is made of a material having a low melt flow index.

20 Claims, 1 Drawing Sheet

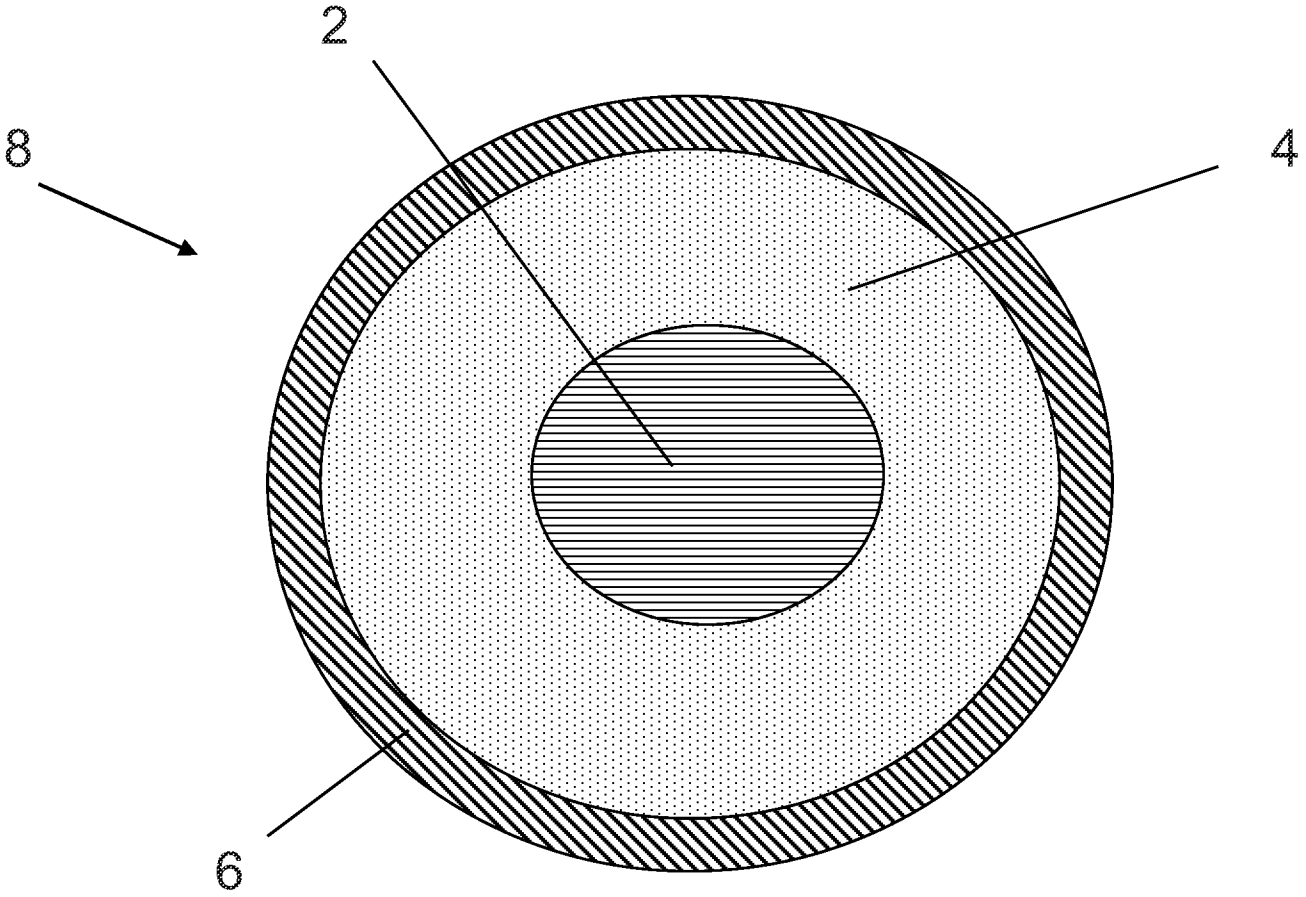
8
2
4
6

COMMUNICATION CABLE

This application claims the priority of U.S. Provisional Patent Application No. 61/249,698 filed Oct. 8, 2009, which is incorporated herein by reference.

FIELD OF THE INVENTION

The present invention relates generally to cables suitable for use in plenum applications. In particular, the present invention relates to twisted pair communication cables and coaxial cables suitable for use in plenum applications (which exhibit flame spread and smoke generation properties that comply with industry standards, e.g., UL 910 or NFPA 262) without compromising electrical performance. The cable has two or more layers of insulation where the inner layer is made of a material having a high melt flow index and the outer layer is made of a material having a low melt flow index.

BACKGROUND OF THE INVENTION

Buildings are usually designed with a space between a drop ceiling and a structural floor from which the ceiling is suspended to serve as a return air plenum for elements of heating and cooling systems as well as serving as a convenient location for the installation of communications cables and other equipment, such as power cables. Alternatively, the building can employ raised floors used for cable routing and plenum space. Communications cables generally include voice communications, data and other types of signals for use in telephone, computer, control, alarm, and related systems, and it is not uncommon for these plenums and the cables therein to be continuous throughout the length and width of each floor, which can introduce safety hazards, both to the cables and the buildings.

When a fire occurs in an area between a floor and a drop ceiling, it may be contained by walls and other building elements which enclose that area. However, if and when the fire reaches the plenum space, and especially if flammable material occupies the plenum, the fire can spread quickly throughout the entire floor of the building. The fire could travel along the length of cables which are installed in the plenum if the cables are not rated for plenum use, i.e., do not possess the requisite flame and smoke retardation characteristics. Also, smoke can be conveyed through the plenum to adjacent areas and to other floors with the possibility of smoke permeation throughout the entire building.

As the temperature in a non-plenum rated jacketed cable rises, charring of the jacket material begins. Afterwards, conductor insulation inside the jacket begins to decompose and char. If the charred jacket retains its integrity, it still functions to insulate the core; if not, however, it ruptures due either to expanding insulation char or to pressure of gases generated from the insulation, and as a consequence, exposes the virgin interior of the jacket and insulation to the flame and/or the elevated temperatures. The jacket and the insulation begin to pyrolize and emit more flammable gases. These gases ignite and, because of air drafts in the plenum, burn beyond the area of flame impingement, thereby propagating flame and generating smoke and toxic and corrosive gases.

Because of the possibility of flame spread and smoke evolution, as a general rule, the National Electrical Code (NEC) requires that power-limited cables in plenums be enclosed in metal conduits. However, the NEC permits certain exceptions to this requirement. For example, cables without metal conduits are permitted, provided that such cables are tested and approved by an independent testing agent, such as Underwriters Laboratories (UL), as having suitably low flame spread and smoke generating or producing characteristics. The flame spread and smoke production of cables are measured using the UL 910, also known as the "Steiner Tunnel," standard test method or, more recently, the NFPA 262 flame test for fire and smoke retardation characteristics of electrical and optical fiber cables used in air handling spaces, i.e., plenums.

Communication systems in the present day environment are of vital importance, and, as technology continues to become more sophisticated, such systems are required to transmit signals substantially error free at higher and higher bit rates. More particularly, it has become necessary to transmit data signals over considerable distances at high bit rates, such as megabits or gigabits per second, and to have substantially error free transmission. Thus, desirably, the medium over which these signals are transmitted must be capable of handling not only low frequency and voice signals, for example, but higher frequency data and video signals.

The most common cable in data communication involves an electrical conductor that is surrounded by a single layer of insulation. Plenum applications typically require that the insulation used contain polymers, generally fluoropolymers. Low melt flow index (MFI) fluoropolymers more readily accommodate the flame and smoke performance when tested per UL 910. The low MFI polymers, however, typically have a higher electrical dissipation factor which can cause poor electrical performance typically at frequencies higher than 100 MHz.

Currently most plenum cables use a higher melt flow material as insulation. That configuration sacrifices the flame and smoke characteristics by using higher melt flow materials to obtain the desired electrical characteristics. Those insulations typically pass the UL910 test, but require the addition of polyvinylchloride (PVC) jacket sheaths or other costly components. For specific high-end 10G applications, the cable requires flame characteristics higher than what could be obtained by exterior PVC jacketing.

It is apparent from the foregoing discussion that there remains a need for a flame retardant, and low-smoke generating communication cable that does not sacrifice transmission properties for fire and smoke resistance.

SUMMARY OF THE INVENTION

It is an object of the present invention to provide a cable, suitable for plenum applications, which is flame resistant and low-smoke generating, without compromising electrical performance.

A further object of the invention is to provide an improved cable which is suitable for plenum applications and has a low dissipation factor for electrical performance at high frequencies.

Other objects and advantages of the invention will be apparent from the following detailed description and the accompanying drawing.

The present invention provides flame retardant and low-smoke cables while retaining an excellent electrical dissipation factor for high electrical performance at high frequency.

In accordance with the present invention, the foregoing objectives are realized by providing a cable containing a conductor core that is covered by at least two layers of insulation material. The first (inner) layer of insulation contains a material having a high melt flow index; and the second (outer) layer of insulation contains a material having a low melt flow index. The outer layer of insulation provides flame resistance and low-smoke characteristics, while the inner layer provides excellent electrical characteristics, particularly low dissipation factor, and acts to contain the inner layer(s), when the cable is subject to heat and/or burning, to reduce dripping of the inner material, thus, mitigating smoke evolution. Wires containing the two layer insulation of the present invention are preferably used in communication cables, such as twisted pair communication cables or coaxial cables.

Methods of making the novel plenum cable are also provided.

The methods and cable of the present invention provide an optimization of materials to obtain both good electrical characteristics and improved flame and smoke characteristics.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein:

FIG. 1 is a drawing showing a cable of the present invention.

DETAILED DESCRIPTION OF THE PREFERRED EMBODIMENTS

Referring to FIG. 1, the cable 8 of the present invention contains an electrical conductor 2 at the core of the cable. The electrical conductor is then surrounded by at least two layers of insulation: an inner insulation layer 4 and an outer insulation layer 6. The inner insulation layer 4 is formed from a material having a high melt flow index (MFI); and the outer insulation layer 6 is formed from a material having a low MFI.

As used herein, "low MFI" is used to mean a MFI of less than about 15. Similarly, "high MFI" is used to mean a MFI of greater than about 20. The MFI of a material can be determined using the method given in ASTM D1238 (2010), which is incorporated herein by reference. MFI is the output rate (flow) in grams that occurs in 10 minutes through a standard die when a fixed pressure is applied to the melt. The specific temperature, pressure, die size, and other test conditionals are specified in ASTM D1238 (2010). As such, the higher a MFI, the more polymer flows under test conditions. Many factors affect a polymer's flow property, including, but not limited to, molecular weight distribution, the presence of co-monomers, the degree of chain branching, crystallinity, fillers, and additives.

The electrical conductor 2 is generally a smooth conducting material such as copper, tinned copper, aluminum or copper-clad steel. The preferred electrical conductor is copper.

The insulation is preferably made from a polymeric material having the prescribed MFI. In some cases, the same polymer can be used for the inner insulation layer 4 and the outer insulation layer 6 as long as the polymer can be adjusted to have the desired MFI. For example, a fluoropolymer with a MFI of less than about 15 can be used for the outer insulation layer 6; and a fluoropolymer with a MFI of greater than about 20 can be used for the inner insulation layer 4. Methods for adjusting the MFI of a polymer are known in the art. For example, additives and fillers can be used to modify the MFI of a polymer. Other factors affecting MFI of a polymer is discussed above.

In a preferred embodiment, the inner insulation contains a material having a MFI of about 12-14; and the outer insulation contains a material having a MFI of about 24-32. Generally, the thickness of the layer is proportional to the desire affect. That is, the higher the thickness of the low MFI material, the better the burn and flame characteristics. The higher the thickness of the high MFI material, the lower the dissipation factor. Here, the lower dissipation factor eventually reaches a point of diminishing returns as related to thickness. Table 1 shows a non-limiting list of appropriate materials for the outer insulation layer.

TABLE 1

| Material | Manufacturer | P/N | MFI nominal | MFI range |
|---|---|---|---|---|
| ECTFE | Solvay | 558 | 18 | 15-20 |
| ECTFE | Solvay | 500LC | 18 | |
| ECTFE | Solvay | 513LC | 19 | |
| ETFE | Daikin | EP-541 | 6 | 4-8 |
| ETFE | Daikin | EP-543 | 7 | 4-9.5 |
| ETFE | Daikin | EP-521 | 12 | 8-16 |
| ETFE | Daikin | EP-620 | 14 | 9-18 |
| ETFE | Dupont | 280 | 4 | |
| ETFE | Dupont | 2181 | 6 | |
| ETFE | Dupont | 2183 | 6 | |
| ETFE | Dupont | 2160 | 7 | 2-11 |
| ETFE | Dupont | 2170 | 7 | 2-11 |
| ETFE | Dupont | 200 | 7 | |
| ETFE | Dupont | 750 | 7 | |
| ETFE | Dupont | 2202 | 7 | |
| ETFE | Dupont | 2185 | 11 | |
| ETFE | Dupont | 2190 | 11 | |
| ETFE | Dyneon | 6235 | 10 | |
| FEP | Daikin | NP-30 | 3 | 2-3.5 |
| FEP | Daikin | NP-130 | 3 | |
| FEP | Daikin | NP120 | 6 | |
| FEP | Daikin | NP-20 | 7 | 4.5-8.5 |
| FEP | Daikin | NP-12x | 18 | 15.6-20 |
| FEP | Dupont | 140 | 3 | |
| FEP | Dupont | CJ-95 | 5 | |
| FEP | Dupont | 100 | 7 | |
| FEP | Dupont | CJ-99 | 9 | |
| FEP | Dupont | TE9811 | 9 | |
| FEP | Dupont | TE9810 | 14 | |
| FEP | Dyneon | 6301 | 1 | |
| FEP | Dyneon | 6303 | 3 | |
| FEP | Dyneon | 6307 | 7 | |
| FEP | Dyneon | 6309 | 9 | |
| MFA | Solvay | F1520 | 3 | 1-4 |
| MFA | Solvay | F1530 | 6 | 4-8 |
| PFA | Daikin | AP-210 | 14 | 10-17 |
| PFA | Dupont | 350 | 2 | |
| PFA | Dupont | 450 | 2 | |
| PFA | Dupont | TE-7224 | 2 | 1-3 |
| PFA | Dupont | 940 | 2 | 1.7-3 |
| PFA | Dupont | 445 | 5 | |
| PFA | Dupont | 950 | 5 | |
| PFA | Dupont | 345 | 7 | 4.1-8.9 |
| PFA | Dupont | 440 | 14 | 12-15 |
| PFA | Dupont | 340 | 14 | |
| PFA | Solvay | P420 | 2 | 1.5-3 |
| PFA | Solvay | P450 | 14 | 10-17 |
| PVDF | Dyneon | 1012 | 2 | |
| PVDF | Dyneon | 1010 | 6 | |
| PVDF | Dyneon | 6010 | 6 | |
| PVDF | Dyneon | 11010 | 6 | |
| PVDF | Dyneon | 6012 | 12 | |
| PVDF | Dyneon | 31008/0009 | 15 | |
| PVDF | Dyneon | 31508/0009 | 15 | |
| PVDF | Dyneon | 32008/0009 | 15 | |
| PVDF | Dyneon | 32008/0010 | 16 | |
| PVDF | Solvay | 460 | 10 | |

ETFE = ethylene tetrafluoroethylene;

FEP = fluoroelthylene propylene;

MFA = copolymer of tetrafluoroethylene (TFE) and perfluoro-methyl vinyl ether (PFMVE); and PFA = copolymer of TFE and perfluoro-propyl vinyl ether;

PVDF = polyvinylidene fluoride.

Even though some of the materials listed in Table 1 have MFIs above 15, it may be possible to modify these materials to produce lower MFIs as required.

Table 2 shows a non-limiting list of appropriate materials for the inner insulation layer.

TABLE 2

| Material | Manufacturer | P/N | MFI nominal | MFI range |
|---|---|---|---|---|
| ETFE | Daikin | EP-610 | 30 | 25-35 |
| ETFE | Dupont | 210 | 20 | |
| ETFE | Dupont | 2195 | 20 | |
| ETFE | Dupont | 207 | 30 | |
| FEP | Daikin | NP101 | 24 | 21-27 |
| FEP | Dupont | TE9475 | 30 | |
| FEP | Dupont | TE9494 | 30 | |
| FEP | Dupont | TE9495 | 30 | |
| FEP | Dyneon | 6322 | 22 | |
| MFA | Solvay | 1041 | 25 | 22-28 |
| MFA | Solvay | F1850-10 | 25 | 22-28 |
| PFA | Daikin | AP-230 | 20 | 15-25 |
| PFA | Daikin | AP-201 | 24 | 18-30 |
| PVDF | Dyneon | 1008 | 24 | |

The insulation layers are preferably extruded over the conductor using methods known in the art. Those layers can be extruded using two separate extrusion steps, where the first extrusion surrounds the conductor with the inner insulation layer having a high MFI, and the second extrusion surrounds and encapsulates the inner insulation layer with the outer insulation layer having a low MFI. In a preferred embodiment, however, the two layers of insulation are extruded in a single extrusion step using methods well-known in the art. The conductor containing the two-layer insulation of the present invention can be used in twisted pair communication cables or in coaxial cables, which are known in the art. Twisted pair communication cables are disclosed, e.g. in U.S. Pat. Nos. 7,643,018, 7,473,848, and 7,449,638, which are incorporated herein by reference.

In certain embodiments, either of the layers or both may foamed, e.g. to enhance the electrical properties. For example, foaming fluoro-polymer layer can lower the dielectric constant and the dissipation factor of the material. Additionally, the foamed layer can improve the overall volume of material which is burned in the UL 910 testing. Method for producing foamed insulation is know in the art and is disclosed, e.g. in U.S. Pat. Nos. 7,638,709 and 4,352,701, which are incorporated herein by reference.

Although certain presently preferred embodiments of the invention have been specifically described herein, it will be apparent to those skilled in the art to which the invention pertains that variations and modifications of the various embodiments shown and described herein may be made without departing from the spirit and scope of the invention. Accordingly, it is intended that the invention be limited only to the extent required by the appended claims and the applicable rules of law.

What is claimed is:

1. An electrical cable comprising an electrical conductor, an inner insulation surrounding the conductor, and an outer insulation surrounding the inner insulation, wherein the inner insulation has a high melt flow index (MFI) and is foamed, and the outer insulation has a low MFI.

2. The cable of claim 1, wherein the low MFI is about 12-14.

3. The cable of claim 1, wherein the high MFI is about 24-32.

4. The cable of claim 1, wherein the inner or outer insulations are made from fluoropolymer.

5. The cable of claim 4, wherein the fluoropolymer is selected from the group consisting of ETFE, FEP, MFA, PFA, and PVDF.

6. The cable of claim 1, wherein the electrical conductor is copper, tinned copper, aluminum or copper-clad steel.

7. The cable of claim 1, wherein the outer insulation is foamed.

8. A method of making an electrical cable comprising the steps of (a) providing an electrical conductor;

(b) surrounding the electrical conductor with an inner insulation having a high melt flow index (MFI) and being foamed; and (c) surrounding the inner insulation with an outer insulation having a low MFI.

9. The method of claim 8, wherein steps (b) and (c) take place in a single extrusion.

10. The method of claim 8, wherein steps (b) and (c) take place in two successive extrusions.

11. The method of claim 8, wherein the low MFI is about 12-14.

12. The method of claim 8, wherein the high MFI is about 24-32.

13. The method of claim 8, wherein the inner or outer insulations are made from fluoropolymer.

14. The method of claim 13, wherein the fluoropolymer is selected from the group consisting of ETFE, FEP, MFA, PFA, and PVDF.

15. The method of claim 8, wherein the electrical conductor is copper, tinned copper, aluminum or copper-clad steel.

16. An insulation for electrical cable comprising a first layer made of a first material having a high melt flow index (MFI) and a second layer made of a second material having a low MFI, wherein the first and second materials are foamed.

17. The insulation of claim 16, herein the low MFI is about 12-14.

18. The insulation of claim 16, wherein the high MFI is about 24-32.

19. The insulation of claim 16, wherein the inner or outer insulations are made from fluoropolymer.

20. The insulation of claim 19, wherein the fluoropolymer is selected from the group consisting of ETFE, FEP, MFA, PFA, and PVDF.

* * * * *